US008277580B2

(12) United States Patent
Dangerfield et al.

(10) Patent No.: US 8,277,580 B2
(45) **Date of Patent: *Oct. 2, 2012**

(54) AL-ZN-CU-MG ALUMINUM BASE ALLOYS AND METHODS OF MANUFACTURE AND USE

(75) Inventors: Vic Dangerfield, Canton, GA (US); Kenneth Paul Smith, Parkersburg, WV (US); Timothy Warner, Voreppe (FR); David Dumont, Gardanne (FR)

(73) Assignees: Constellium France, Courbevoie (FR); Constellium Rolled Products Ravenswood, LLC, Ravenswood, WV (US)

( * ) Notice: Subject to any disclaimer, the term of this patent is extended or adjusted under 35 U.S.C. 154(b) by 304 days.

This patent is subject to a terminal disclaimer.

(21) Appl. No.: 11/350,721

(22) Filed: Feb. 10, 2006

(65) Prior Publication Data

US 2006/0191609 A1 Aug. 31, 2006

Related U.S. Application Data

(60) Provisional application No. 60/651,197, filed on Feb. 10, 2005.

(51) Int. Cl.
*C22C 21/10* (2006.01)

(52) U.S. Cl. ..... 148/417; 148/552

(58) Field of Classification Search ..... 148/552, 148/417, 532

See application file for complete search history.

(56) References Cited

U.S. PATENT DOCUMENTS

| | | | | |
|---|---|---|---|---|
| 5,865,911 | A | 2/1999 | Miyasato | |
| 6,027,582 | A | 2/2000 | Shahani | |
| 6,315,842 | B1 | 11/2001 | Shahani et al. | |
| 6,972,110 | B2 | 12/2005 | Chakrabarti | |
| 7,452,429 | B2 * | 11/2008 | Boselli et al. | 148/417 |
| 7,520,945 | B2 * | 4/2009 | Dumont et al. | 148/417 |
| 2002/0121319 | A1 * | 9/2002 | Chakrabarti et al. | 148/694 |
| 2005/0006010 | A1 * | 1/2005 | Benedictus et al. | 148/552 |
| 2005/0058568 | A1 * | 3/2005 | Boselli et al. | 420/531 |
| 2005/0150578 | A1 * | 7/2005 | Bes et al. | 148/439 |
| 2005/0167016 | A1 * | 8/2005 | Dumont et al. | 148/695 |
| 2005/0189044 | A1 * | 9/2005 | Benedictus et al. | 148/552 |

FOREIGN PATENT DOCUMENTS

| | | |
|---|---|---|
| EP | 0829552 | 3/1998 |
| SU | 450846 | 11/1974 |
| SU | 1795589 | 9/1996 |
| WO | 2004/001080 | 12/2003 |

(Continued)

OTHER PUBLICATIONS

European standard EN515 (1993) pp. 1-20.

(Continued)

*Primary Examiner* — Jie Yang

(74) *Attorney, Agent, or Firm* — Baker, Donelson, Bearman, Caldwell & Berkowitz, PC

(57) ABSTRACT

A rolled or forged Al—Zn—Cu—Mg aluminum-based alloy wrought product having a thickness from 2 to 10 inches. The product has been treated by solution heat-treatment, quenching and aging, and the product comprises (in weight-%): Zn 6.2-7.2, Mg 1.5-2.4, Cu 1.7-2.1. Fe 0-0.13, Si 0-0.10, Ti 0-0.06, Zr 0.06-0.13, Cr 0-0.04, Mn 0-0.04, Mn 0-0.04, impurities and other incidental elements ≦0.05 each. Alloys per se and aircraft and aerospace uses, as well as methods of making products are also disclosed.

15 Claims, 2 Drawing Sheets

FOREIGN PATENT DOCUMENTS

WO 2004/090185 10/2004

OTHER PUBLICATIONS

M.V. Hyatt "Program to Improve the Fracture Toughness and Fatigue Resistance of Aluminum Sheet and Plate for Airframe Application" AFML-TR-73-224, (1973); pp. 1-210.

Aleris Aluminum Koblenz GmgH "Opposition against EP-1861516-B1 (application No. 067346143.7-2122)" (2010); pp. 2-22.

* cited by examiner

AL-ZN-CU-MG ALUMINUM BASE ALLOYS AND METHODS OF MANUFACTURE AND USE

CROSS REFERENCE TO RELATED APPLICATIONS

This application claims priority from U.S. Provisional Application Ser. No. 60/651,197, filed Feb. 10, 2005, the content of which is incorporated herein by reference in its entirety.

BACKGROUND OF THE INVENTION

1. Field of the Invention

The present invention relates generally to aluminum base alloys and more particularly, Al—Zn—Cu—Mg aluminum base alloys.

2. Description of Related Art

Al—Zn—Cu—Mg aluminum base alloys have been used extensively in the aerospace industry for many years. With the evolution of airplane structures and efforts directed towards the goal of reducing both weight and cost, an optimum compromise between properties such as strength, toughness and corrosion resistance is continuously sought. Also, process improvement in casting, rolling and annealing can advantageously provide further control in the composition diagram of an alloy.

Thick rolled, forged or extruded products made of Al—Zn—Cu—Mg aluminum base alloys are used in particular to produce integrally machined high strength structural parts for the aeronautic industry, for example wing elements such as wing spars and the like, which are typically machined from thick wrought sections.

The performance values obtained for various properties such as static mechanical strength, fracture toughness, resistance to stress corrosion cracking, quench sensitivity, fatigue resistance, level of residual stress will determine the overall performance of the product, the ability for a structural designer to use it advantageously, as well as the ease it can be used in further processing steps such as, for example, machining.

Among the above listed properties some are often conflicting in nature and a compromise generally has to be found. Conflicting properties are, for example, static mechanical strength verses toughness and strength verses resistance to stress corrosion cracking.

Al—Zn—Mg—Cu alloys with high fracture toughness and high mechanical strength are described in the prior art.

As an example, U.S. Pat. No. 5,865,911 describes an aluminum alloy consisting essentially of (in weight %) about 5.9 to 6.7% zinc, 1.8 to 2.4% copper, 1.6 to 1.86% magnesium, 0.08 to 0.15% zirconium balance aluminum and incidental elements and impurities. The '911 patent particularly mentions the compromise between static mechanical strength and toughness.

U.S. Pat. No. 6,027,582 describes a rolled, forged or extruded Al—Zn—Mg—Cu aluminum base alloy products greater than 60 mm thick with a composition of (in weight %), Zn: 5.7-8.7, Mg: 1.7-2.5, Cu: 1.2-2.2, Fe: 0.07-0.14, Zr: 0.05-0.15 with Cu+Mg<4.1 and Mg>Cu. The '582 patent also describes improvements in quench sensitivity.

U.S. Pat. No. 6,972,110 teaches an alloy, which contains preferably (in weight %) Zn: 7-9.5, Mg: 1.3-1.68 and Cu 1.3-1.9 and encourages keeping Mg≦(Cu+0.3). The '110 patent discloses using a three step aging treatment in order to improve resistance to stress corrosion cracking. A three step aging is long and difficult to master and it would be desirable to obtain high corrosion resistance without necessarily requiring such a thermal treatment.

SUMMARY OF THE INVENTION

An object of the invention was to provide an Al—Zn—Cu—Mg alloy having a specific composition range that enables, for wrought products, an improved compromise among mechanical strength for an appropriate level of fracture toughness and resistance to stress corrosion.

Another object of the invention was the provision of a manufacturing process of wrought aluminum products which enables an improved compromise among mechanical strength for an appropriate level of fracture toughness and resistance to stress corrosion.

To achieve these and other objects, the present invention is directed to a rolled or forged aluminum-based alloy wrought product having a thickness from 2 to 10 inches comprising, or advantageously consisting essentially of (in weight %):

Zn 6.2-7.2
Mg 1.5-2.4
Cu 1.7-2.1
Fe 0-0.13
Si 0-0.10
Ti 0-0.06
Zr 0.06-0.13
Cr 0-0.04
Mn 0-0.04 impurities and other incidental elements ≦0.05 each.

After shaping, the product is treated by solution heat-treatment, quenching and aging and in a preferred embodiment has the following properties:

a) a minimum life without failure after stress corrosion cracking of at least 50 days, and preferentially at least 70 days at a ST stress level of 40 ksi,
b) a conventional tensile yield strength measured in the L direction at quarter thickness higher than 70-0.32t ksi (t being the thickness of the product in inch), preferably higher than 71-0.32t ksi and even more preferentially higher than 72-0.32t ksi,
c) a toughness in the L-T direction measured at quarter thickness higher than 42-1.7t ksi√in (t being the thickness of the product in inch).

The present invention is also directed to a process for the manufacture of a rolled or forged aluminum-based alloy wrought product comprising the steps of:

a) casting an ingot comprising, or advantageously consisting essentially of (in weight-%)

Zn 6.2-7.2
Mg 1.5-2.4
Cu 1.7-2.1
Fe 0-0.13
Si 0-0.10
Ti 0-0.06
Zr 0.06-0.13
Cr 0-0.04
Mn 0-0.04 impurities and other incidental elements ≦0.05 each.

b) homogenizing the ingot at 860-930° F., or preferentially at 875-905° F.;
c) hot working the ingot to a plate with a final thickness from 2 to 10 inches with an entry temperature of 640-825° F., and preferentially 650-805° F.;
d) solution heat treating and quenching the plate;
e) stretching the plate with a permanent set from 1 to 4% f) aging the plate by heating at 230-250° F. for 5 to 12 hours and 300-350° F. for 5 to 30 hours, for an equivalent time t(eq) between 31 and 56 hours and preferentially between 33 and 44 hours.

The equivalent time t(eq) is defined by the formula:

$$t(eq) = \frac{\int \exp(-16000/T)dt}{\exp(-16000/T_{ref})}$$

where T is the instantaneous temperature in ° K during annealing and $T_{ref}$ is a reference temperature selected at 302° F. (423° K), where t(eq) is expressed in hours.

Figure 1:
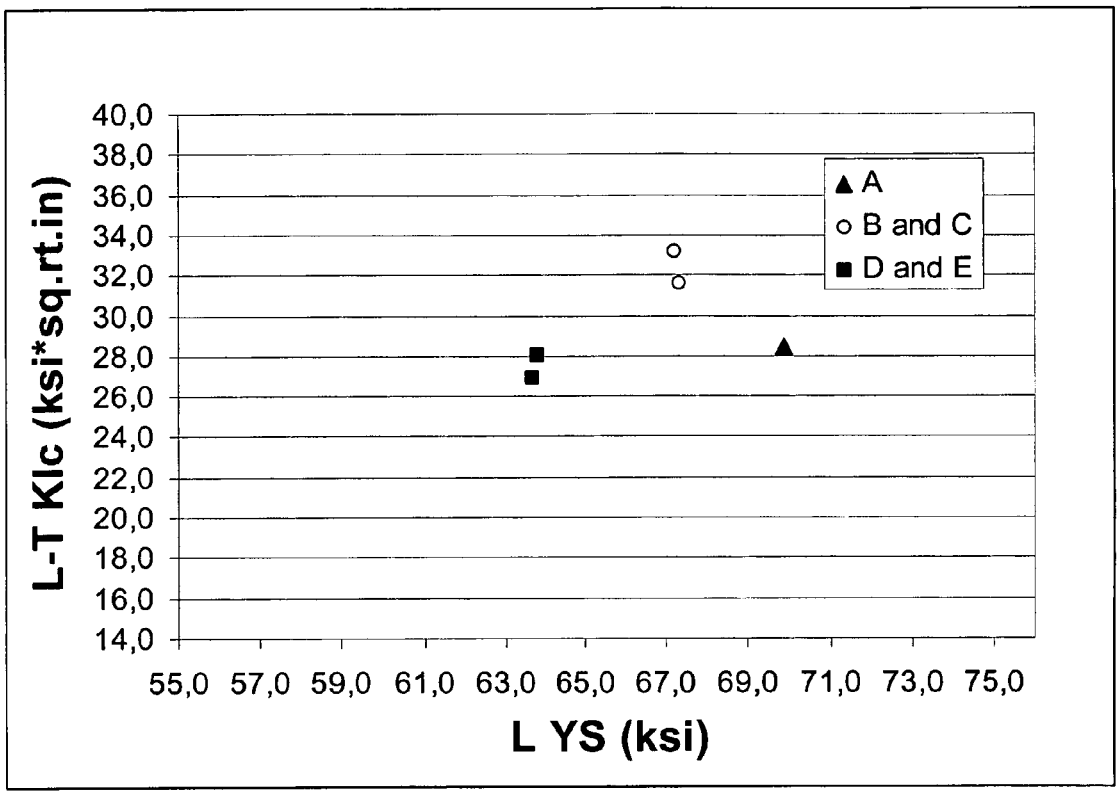
FIG. 1: TYS (L)-$K_{1C}$(L-T) plots of inventive plate A (8") vs 7040 (reference B and C of thickness 8.27") and 7050 (reference D and E of thickness 8").

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF A PREFERRED EMBODIMENT

Unless otherwise indicated, all the indications relating to the chemical composition of the alloys are expressed as a mass percentage by weight based on the total weight of the alloy. Alloy designation is in accordance with the regulations of The Aluminium Association, known to those skilled in the art. The definitions of tempers are laid down in ASTM E716, E1251.

Unless mentioned otherwise, static mechanical characteristics, i.e., the ultimate tensile strength UTS, the tensile yield stress TYS and the elongation at fracture E, are determined by a tensile test according to standard ASTM B557, the location at which the pieces are taken and their direction being defined in standard AMS 2355.

The fracture toughness $K_{1C}$ is determined according to ASTM standard E399. A plot of the stress intensity versus crack extension, known as the R curve, is determined according to ASTM standard E561. The critical stress intensity factor $K_C$, in other words the intensity factor that makes the crack unstable, is calculated starting from the R curve. The stress intensity factor $K_{CO}$ is also calculated by assigning the initial crack length to the critical load, at the beginning of the monotonous load. These two values are calculated for a test piece of the required shape. $K_{app}$ denotes the $K_{CO}$ factor corresponding to the test piece that was used to make the R curve test.

It should be noted that the width of the test panel used in a toughness test could have a substantial influence on the stress intensity measured in the test. CT-specimen were used. The width W was unless otherwise mentioned 5 inch (127 mm) with B=0.3 inch and the initial crack length ao=1.8 inch.

SCC studies were carried out according to ASTM standard G47 and G49 in ST direction for samples at half thickness T/2.

The term "structural member" is a term well known in the art and refers to a component used in mechanical construction for which the static and/or dynamic mechanical characteristics are of particular importance with respect to structure performance, and for which a structure calculation is usually prescribed or undertaken. These are typically components the rupture of which may seriously endanger the safety of the mechanical construction, its users or third parties. In the case of an aircraft, structural members comprise members of the fuselage (such as fuselage skin), stringers, bulkheads, circumferential frames, wing components (such as wing skin, stringers or stiffeners, ribs, spars), empennage (such as horizontal and vertical stabilizers), floor beams, seat tracks, and doors.

An aluminum-zinc-magnesium-copper wrought product according to one advantageous embodiment of the invention has the following composition (limits included):

TABLE 1

Compositional Ranges of inventive Alloys (wt. %, balance Al) in one embodiment

| | Zn | Mg | Cu |
|---|---|---|---|
| Broad | 6.2-7.2 | 1.5-2.4 | 1.7-2.1 |
| Preferred | 6.6-7.0 | 1.5-1.8 | 1.7-2.1 |
| More preferred | 6.7-7.0 | 1.68-1.8 | 1.7-2.0 |
| Even more preferred | 6.72-6.98 | 1.68-1.8 | 1.75-2.0 |

Still another embodiment of the invention, the compositional ranges of the invention alloy is the following:

Zn: 6.6-7.0, Mg: 1.68-2.4, Cu: 1.3-2.3

A minimum level of solutes (Zn, Mg and Cu) may be beneficial or necessary in some embodiments to obtain the desired strength. Zn+Cu+Mg is preferably higher than 10 wt. % and preferentially higher than 10.3 wt. %. For the same reason, the Zn content should preferably comprise at least about 6.2 wt. % and preferentially at least 6.6 wt. %, 6.7 wt. % or even 6.72 wt. %, which makes it generally higher than the Zn content of a 7040 or a 7050 alloy. Similarly, Cu+Mg is preferably higher than about 3.3 wt. % and preferentially higher than about 3.5 wt. %.

On the other hand, it may be advantageous in some embodiments, to limit the zinc quantity in order to obtain a high corrosion resistance without the use of a difficult 3 step aging treatment. For this reason the Zn content should advantageously remain below about 7.2 wt. % and preferentially below 7.0 wt. % or even 6.98 wt. %, which makes it generally lower than the Zn content of a 7085 alloy.

High content of Mg and Cu may affect fracture toughness performance. The combined content of Mg and Cu should preferably be maintained below about 4.0 wt. % and preferentially below about 3.8 wt. %.

An alloy suitable for the present invention further contains zirconium, which is typically used for grain size control. The Zr content should preferably comprise at least about 0.06 wt. %, and preferentially about 0.08 wt. % in order to affect the recrystallization, but should advantageously remain below about 0.13 wt. % and preferentially below 0.12 wt. % in order to minimize quench sensitivity and to reduce problems during casting.

Titanium, associated with either boron or carbon can usually be added if desired during casting in order to limit the as-cast grain size. The present invention may typically accommodate up to about 0.06 wt. % or about 0.05 wt. % Ti. In a preferred embodiment of the invention, the Ti content is about 0.02 wt. % to about 0.06 wt. % and preferentially about 0.03 wt. % to about 0.05 wt. %.

The present alloy can further contain other elements to a lesser extent and in some embodiments, on a less preferred basis. Iron and silicon typically affect fracture toughness properties. Iron and silicon content should generally be kept low, for example preferably not exceeding about 0.13 wt. % or preferentially about 0.10 wt. % for iron and not exceeding about 0.10 wt. % or preferentially about 0.08 wt. % for silicon. In one embodiment of the present invention, iron and silicon content are ≦0.07 wt. %. Chromium is preferentially avoided and it should typically be kept below about 0.04 wt. %, and preferentially below about 0.03 wt. %. Manganese is also preferentially avoided and it should generally be kept below about 0.04 wt. % and preferentially below about 0.03 wt. %. In one embodiment of the present invention, the alloy is substantially chromium and manganese free (meaning there is no deliberate addition of Mn or Cr, and these elements if present, are present at levels at not more than impurity level, which can be less than or equal to 0.01 wt %). Elements such as Mn and Cr can increase quench sensitivity and as such in some cases can advantageously be kept below or equal to about 0.01 wt. %.

A suitable process for producing wrought products according to the present invention comprises: (i) casting an ingot or a billet made in an alloy according to the invention, (ii) conducting a homogenization at a temperature from about 860 to about 930° F. or preferentially from about 875 to about 905° F., (iii) conducting a hot transformation in one or more stages by rolling or forging, with an entry temperature comprised from about 640 to about 825° F. and preferentially between about 650 and about 805° F., to a plate with a final thickness from 2 to 10 inch, (iv) conducting a solution heat treatment at a temperature from about 850 to about 920° F. and preferentially between about 890 and about 900° F. for 5 to 30 hours, (v) conducting a quenching, preferentially with room temperature water, (vi) conducting stress relieving by controlled stretching or compression with a permanent set of preferably less than 5% and preferentially from 1 to 4%, and, (vii) conducting an aging treatment.

In an embodiment of the present invention, the hot transformation starting temperature is preferably from 640 to 700° F. The present invention finds particular utility in thick gauges of greater than about 3 inches. In a preferred embodiment, a wrought product of the present invention is a plate having a thickness from 4 to 9 inches, or advantageously from 6 to 9 inches comprising an alloy according to the present invention. "Over-aged" tempers ("T7 type") are advantageously used in order to improve corrosion behavior in the present invention. Tempers that can suitably be used for the products according to the invention, include, for example T6, T651, T74, T76, T751, T7451, T7452, T7651 or T7652, the tempers T7451 and T7452 being preferred. Aging treatment is advantageously carried out in two steps, with a first step at a temperature comprised between 230 and 250° F. for 5 to 20 hours and preferably for 5 to 12 hours and a second step at a temperature comprised between 300 and 360° F. and preferably between 310 and 330° F. for 5 to 30 hours.

In an advantageous embodiment, the equivalent aging time t(eq) is comprised between 31 and 56 hours and preferentially between 33 and 44 hours.

The equivalent time t(eq) at 302° F. being defined by the formula:

$$t(eq) = \frac{\int \exp(-16000/T)dt}{\exp(-16000/T_{ref})}$$

where T is the instantaneous temperature in ° K during annealing and $T_{ref}$ is a reference temperature selected at 302° F. (423° K). t(eq) is expressed in hours.

The narrow composition range of the alloy from the invention, selected mainly for a strength versus toughness compromise provided wrought products with unexpectedly high corrosion resistance.

Wrought products according to the present invention are advantageously used as or incorporated in structural members for the construction of aircraft.

In an advantageous embodiment, the products according to the invention are used in wing spars.

These, as well as other aspects of the present invention, are explained in more detail with regard to the following illustrative and non-limiting examples.

EXAMPLES

Example 1

Seven ingots were cast, one of a product according to the invention (A), 2 of the standard alloy 7040 (B,C) and four of the standard alloy 7050 (D, E, F and G), with the following composition (Table 2):

TABLE 2 composition (wt. %) of cast according to the invention and of reference casts.

| | | Si | Fe | Cu | Mn | Mg | Cr | Zn | Ti | Zr |
|---|---|---|---|---|---|---|---|---|---|---|
| A (Invention) | | 0.07 | 0.08 | 1.97 | 0.0035 | 1.68 | 0.0005 | 6.8 | 0.04 | 0.11 |
| B (Reference) | "7040" | 0.04 | 0.05 | 1.57 | 0.0043 | 1.97 | 0.0323 | 6.4 | 0.037 | 0.11 |
| C (Reference) | "7040" | 0.04 | 0.07 | 1.52 | 0.0001 | 1.90 | 0.0005 | 6.3 | 0.03 | 0.11 |
| D (Reference) | "7050" | 0.04 | 0.07 | 2.30 | 0.0065 | 2.04 | 0.01445 | 6.3 | 0.034 | 0.08 |
| E (Reference) | "7050" | 0.05 | 0.07 | 2.25 | 0.0082 | 2.01 | 0.0065 | 6.2 | 0.032 | 0.09 |
| F (Reference) | "7050" | 0.05 | 0.07 | 2.22 | 0.0021 | 2.08 | 0.0042 | 6.2 | 0.033 | 0.09 |
| G (Reference) | "7050" | 0.03 | 0.06 | 2.09 | 0.0001 | 2.02 | 0.0005 | 6.4 | 0.030 | 0.08 |

The ingots were then scalped and homogenized at 870 to 910° F. The ingots were hot rolled to a plate of thickness comprised between 8.0 inch (203 mm) and 8.5 inch (208 mm) finish gauge (plate A, and B to G). Hot rolling entry temperature was 802° F. (plate A). For reference plates, hot rolling entry temperature was comprised between 770 and 815° F. The plates were solution heat treated with a soak temperature of 890-900° F. for 10 to 13 hours. The plates were quenched and stretched with a permanent elongation of 1.87% (plate A) and comprised between 1.5 and 2.5% for reference plates.

The time interval between quenching and stretching is important for the control of the level of residual stress, according to the invention this time interval is preferentially less than 2 hours and even more preferentially less than 1 hour. For plate A the time interval between quenching and stretching was 39 minutes.

Plate A was submitted to a two step aging: 6 hours at 240° F. and 24 hours at 310° F. and reference plates were submitted to standard two steps aging.

The temper resulting from this thermo-mechanical treatment was T7451. All the samples tested were substantially unrecrystallized, with a volume fraction of recrystallized grains lower than 35%.

The samples were mechanically tested to determine their static mechanical properties as well as their resistance to crack propagation. Tensile yield strength, ultimate strength and elongation at fracture are provided in Table 3.

TABLE 3

Static mechanical properties of the samples

| | | L Direction | | | LT Direction | | | ST Direction | | |
|---|---|---|---|---|---|---|---|---|---|---|
| Sample | Thickness | UTS (ksi) | TYS (ksi) | E (%) | UTS (ksi) | TYS (ksi) | E (%) | UTS (ksi) | TYS (ksi) | E (%) |
| A | 8.0 | 74.5 | 69.9 | 9.3 | 75.1 | 67.7 | 4.2 | 71.9 | 63.2 | 4.0 |
| B | 8.27 | 72.3 | 67.3 | 10.8 | 72.7 | 66.3 | 6.9 | 69.2 | 62.2 | 6.4 |
| C | 8.27 | 72.8 | 67.2 | 10.2 | 74.2 | 65.6 | 6.2 | 70.1 | 60.8 | 5.7 |
| D | 8.0 | 72.2 | 63.6 | 9.0 | 71.8 | 61.3 | 7.2 | 69.5 | 58.8 | 5.7 |
| E | 8.0 | 72.6 | 63.7 | 9.0 | 72.0 | 61.3 | 5.7 | 69.4 | 58.2 | 4.7 |
| F | 8.5 | 71.1 | 62.1 | 9.0 | 70.6 | 60.2 | 6.2 | 67.7 | 57.5 | 4.7 |
| G | 8.5 | 71.1 | 62.1 | 9.0 | 72.1 | 60.6 | 7.0 | 69.0 | 57.1 | 5.5 |

The sample according to the invention exhibits a higher strength than all comparative examples. Comparatively to 7050 plates, the improvement in tensile yield strength in the L-direction is higher than 10%. Comparatively to 7040 plates, the improvement is almost 4%.

Results of the fracture toughness testing are provided in Table 4.

TABLE 4

Fracture toughness properties of the samples

| | | $K_{1C}$ | | | $K_{app}$ | |
|---|---|---|---|---|---|---|
| Sample | Thickness | L–T (ksi√in) | T–L (ksi√in) | S–L (ksi√in) | L–T (ksi√in) | T–L (ksi√in) |
| A | 8.0 | 28.5 | 21.5 | 24.1 | 58.8 | 34.5 |
| B | 8.27 | 31.6 | 25.5 | 27.5 | | |
| C | 8.27 | 33.2 | 24.5 | 24.3 | | |
| D | 8.0 | 27.0 | 22.8 | 24.9 | | |
| E | 8.0 | 28.1 | 22.5 | 23.8 | | |
| F | 8.5 | | | 25.3 | 52.2 | 34.4 |
| G | 8.5 | | | 27.1 | 55.2 | 37.4 |

FIG. 1 shows a cross plot of L-T plane-strain fracture toughness ($K_{1C}$) versus longitudinal tensile yield strength TYS (L), both samples having been taken from the quarter plane (T/4) location of the plate. The inventive sample exhibited higher strength and comparable fracture toughness than samples B and C (7040) and higher strength with higher fracture toughness than samples D and E (7050). (See FIG. 1 for details as to the specific values of higher strength and higher fracture toughness achieved.)

Figure 2:
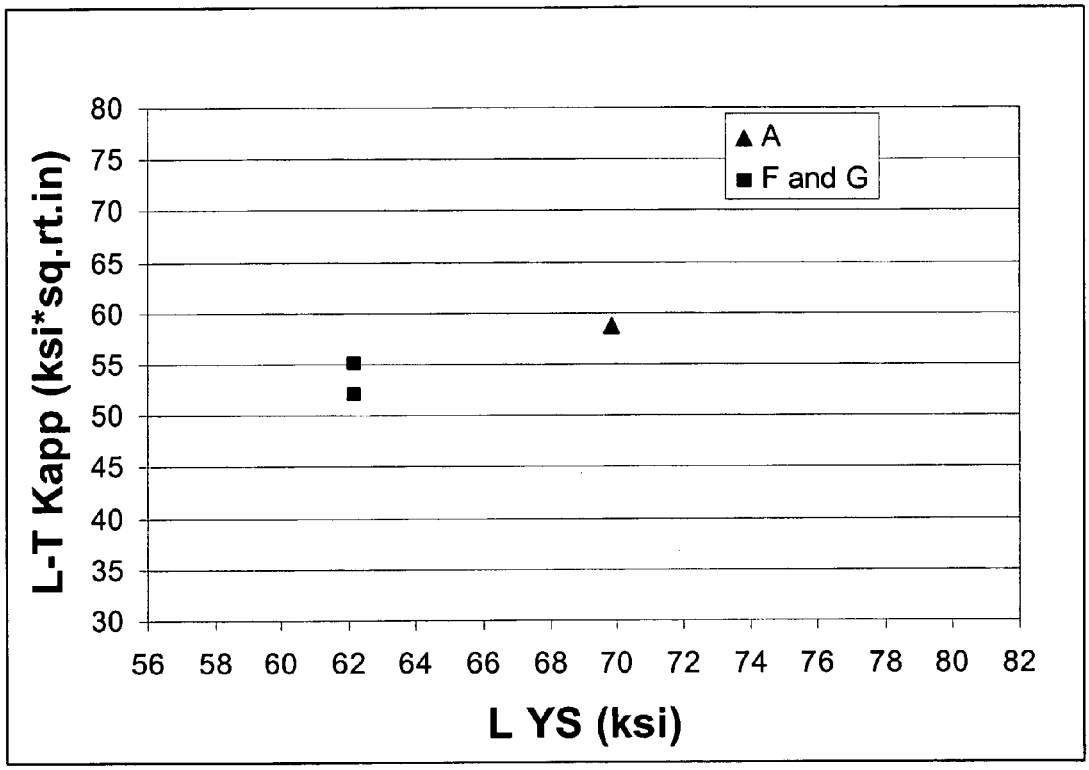
FIG. 2: TYS (L)-$K_{app}$ (L-T) plots of inventive plate A (8") vs 7050 (reference F and G of thickness 8.5").

FIG. 2 shows a cross plot of L-T fracture toughness ($K_{app}$) versus longitudinal tensile yield strength TYS (L), both samples having been taken from the quarter plane (T/4) location of the plate. The inventive sample exhibited higher strength and higher fracture toughness than samples F and G (7050). (See FIG. 2 for details as to values achieved in terms of higher strength and higher fracture toughness.)

The stress-corrosion resistance of alloy A (inventive) plates in the short transverse direction was measured following ASTM G49 standard. ST tensile specimen were tested under 25, 36 and 40 ksi tensile stress. No samples failed within 50 days of exposure. This performance is far exceeding the guaranteed minimum of reference 7050 and 7040 products, which is 20 days exposure at stresses of 35 ksi, according to ASTM G47. The inventive alloy A exhibited outstanding corrosion performance compared to known prior art. It was particularly impressive and unexpected that a plate according to the present invention exhibited a higher level of stress corrosion cracking resistance simultaneously with a higher tensile strength and a comparable fracture toughness compared to prior art samples.

Example 2

Three different aging treatments were tested on the quenched and stretched inventive plate A from example 1. The plates were subjected to a two steps aging with a first stage between 230 and 250° F. and a second stage between 300 and 350° F., this two step treatment being characterized by an equivalent time t(eq) between 20 and 37 hours, expressed by the equation:

$$t(eq) = \frac{\int \exp(-16000/T)dt}{\exp(-16000/T_{ref})}$$

in which T (in Kelvin) indicates the temperature of the heat treatment which continues for a time t (in hours) and $T_{ref}$ is a reference temperature, here set at 423K or 302° F.

The static mechanical properties and $K_{1C}$ toughness are presented in Table 5.

TABLE 5 mechanical properties of sample aged in different conditions

| | L | | | LT | | | ST | | | | | |
|---|---|---|---|---|---|---|---|---|---|---|---|---|
| | UTS | LYS | | UTS | LYS | | UTS | LYS | | $K_{1C}$ (ksi√in) | | |
| t(eq) | (ksi) | (ksi) | E (%) | (ksi) | (ksi) | E (%) | (ksi) | (ksi) | E (%) | L–T | T–L | S–L |
| 22 | 76.6 | 73.2 | 8.0 | 77.3 | 70.9 | 2.8 | 73.5 | 65.3 | 4.5 | 28.0 | 21.5 | 24.0 |
| 29 | 75.4 | 71.2 | 8.7 | 76.2 | 68.7 | 4.5 | 72.6 | 64.2 | 4.2 | 28.3 | 21.6 | 24.4 |
| 36 | 74.5 | 69.9 | 9.3 | 75.1 | 67.7 | 4.2 | 71.9 | 63.2 | 4.0 | 28.5 | 21.5 | 24.1 |

The slope of the evolution of strength with increasing equivalent time was surprisingly and unexpectedly low, with a drop in strength of only about 2 ksi for an increase of equivalent time from 22 to 36 hours. On the other hand, the stress corrosion properties dramatically improved with the equivalent time of 36 hours. Thus, no samples failed within 50 days of exposure in this aging condition for a stress level of 40 ksi, whereas no sample survived more than 20 days for a similar stress level for the other two aging comparative conditions.

Example 3

In this example, a 7040 plate was aged to a strength similar to the strength obtained for plate A in example 1, in order to compare the corrosion performance.

The composition of the ingot is provided in Table 6.

TABLE 6

Composition (wt. %) of reference ingot H

| | Si | Fe | Cu | Mn | Mg | Cr | Zn | Ti | Zr |
|---|---|---|---|---|---|---|---|---|---|
| H (7040) | 0.04 | 0.05 | 1.58 | 0.0001 | 1.90 | 0.001 | 6.5 | 0.03 | 0.10 |

The ingot was transformed into a plate of gauge 7.28 inch with conditions in the same range as 7040 ingots described in example 1. The plate was finally aged in order to obtain a strength as close as possible to the strength of plate A described in example 1. Mechanical properties of plate H are provided in Table 7.

TABLE 7

Mechanical properties of plate H (measured at T/4).

| | | L Direction | | | LT Direction | | | $K_{1C}$ | $K_{1C}$ |
|---|---|---|---|---|---|---|---|---|---|
| Sample | Thickness | UTS (ksi) | TYS (ksi) | E (%) | UTS (ksi) | TYS (ksi) | E (%) | L–T (ksi√in) | T–L (ksi√in) |
| H | 7.28 | 75.5 | 72.2 | 12.5 | 78.2 | 71.3 | 5 | 30.2 | 24.3 |

The stress-corrosion resistance of plate H was tested in the short transverse direction following ASTM G49 standard. ST tensile specimen were tested under 36 ksi tensile stress. Only one sample out of three did not fail within 40 days of exposure. This result further emphasizes the outstanding performance of plate A of example 1, for which no sample failed within 50 days of exposure at under a higher tensile stress (40 ksi).

Example 4

Three ingots were cast, one of an alloy according to the invention (J), and two reference alloys (K and L), with the following compositions (Table 8):

TABLE 8 composition (wt. %) of the casts.

| | Si | Fe | Cu | Mn | Mg | Cr | Zn | Ti | Zr |
|---|---|---|---|---|---|---|---|---|---|
| J (invention) | 0.05 | 0.06 | 1.72 | 0.0001 | 1.75 | 0.0005 | 6.6 | 0.04 | 0.11 |
| K (reference) | 0.03 | 0.07 | 1.53 | 0.0001 | 1.73 | 0.0005 | 6.3 | 0.04 | 0.11 |
| L (reference) | 0.05 | 0.09 | 2.24 | 0.0001 | 2.11 | 0.0005 | 6.2 | 0.03 | 0.09 |

The ingots were then scalped and homogenized to 870-910° F. The inventive ingot was hot rolled to a plate with a thickness of 6.66 inch (169 mm) finish gauge, and the reference ingots were hot rolled to a plate with a thickness of 6.5 inch (165 mm). Hot rolling entry temperature was 808° F. for plate J. For reference plates, hot rolling entry temperature was comprised between 770 and 815° F. The plates were solution heat treated with a soak temperature of 890-900° F. for 10 to 13 hours. The plates were quenched and stretched with a permanent elongation of 2.25% (plate J) and comprised between 1.5 and 2.5% for reference plates. The time interval between quenching and stretching was 64 minutes for plate J.

Plate J was submitted to a two step aging: 6 hours at 240-260° F. and 12 hours at 315-335° F. and standard two step aging conditions known in the art were employed for reference samples.

The temper resulting from this thermo-mechanical treatment was T7451.

The samples were mechanically tested to determine their static mechanical properties as well as their resistance to crack propagation. Tensile yield strength, ultimate strength and elongation at fracture are provided in Table 9.

TABLE 9

| Static mechanical properties of the samples | | | | | | | | | | |
|---|---|---|---|---|---|---|---|---|---|---|
| | | L Direction | | | LT Direction | | | ST Direction | | |
| Sample | Thickness | UTS (ksi) | TYS (ksi) | E (%) | UTS (ksi) | TYS (ksi) | E (%) | UTS (ksi) | TYS (ksi) | E (%) |
| J | 6.6 | 70.6 | 63.7 | 13.8 | 71.5 | 62.4 | 8, 5 | 68.3 | 58.7 | 6.8 |
| K | 6.5 | 73.3 | 68.2 | 14.5 | 76.2 | 68.6 | 8, 5 | 71.5 | 62.3 | 6 |
| L | 6.5 | 72.2 | 63.7 | 10.5 | 72.9 | 60.9 | 8 | 70.1 | 59.1 | 5.5 |

Results of the fracture toughness testing are provided in Table 10.

TABLE 10

| Fracture toughness properties of the samples | | | | |
|---|---|---|---|---|
| | | $K_{1C}$ | $K_{app}$ | |
| Sample | Thickness | S-L (Ksi√in) | L-T (Ksi√in) | T-L (Ksi√in) |
| J | 6.6 | 35.3 | 85.7 | 56.1 |
| K | 6.5 | 31.9 | 84.7 | 47.4 |
| L | 6.5 | 25.5 | 57.8 | 37.3 |

Inventive plate J exhibited very high fracture toughness, particularly in the S-L and T-L directions. $K_{1C}$ improvement in the S-L direction was more than 10% when compared to sample J and almost 40% when compared to sample L.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

In the present description and in the following claims, to the extent a numerical value is enumerated, such value is intended to refer to the exact value and values close to that value that would amount to an insubstantial change from the listed value.

The invention claimed is:

1. A rolled or forged Al—Zn—Cu—Mg aluminum-based alloy wrought product having a thickness from 3 to 9 inches, wherein said product has been treated by solution heat-treatment, quenching and aging, and wherein said product has a volume fraction of recrystallized grains lower than 35% and said product consisting essentially of (in weight-%):

Al
Zn 6.7-7.0
Mg 1.68-1.8
Cu 1.7-1.97
Fe 0-0.13
Si 0-0.10
Ti 0-0.06
Zr 0.08-0.13
Cr 0-0.04
Mn 0-0.04
impurities and other incidental elements ≦0.05 each, wherein said product comprises the following properties:

a) a minimum life without failure after stress corrosion cracking (SCC) of at least 50 days at a short transverse (ST) stress level of 40 ksi, b) a conventional tensile yield strength measured in the L direction at quarter thickness of at least 70-0.32t ksi (t being the thickness of the product in inch), and c) toughness in the L-T direction measured at quarter thickness of at least 42-1.7t ksi √in (t being the thickness of the product in inch).

2. A product according to claim 1, wherein Fe≦0.07 and Si≦0.07.

3. A product according to claim 1, wherein

Zn 6.72-6.98
Cu 1.75-1.97.

4. A product according to claim 1, wherein said product is in an overaged temper.

5. An aircraft or aerospace product comprising a product of claim 4.

6. A product according to claim 1, wherein said product is in the T74 temper.

7. A product according to claim 1 wherein the thickness thereof is from 4 to 9 inches.

8. A structural member suitable for the construction of aircraft, comprising a product according to claim 1.

9. A structural member suitable for the construction of aircraft, incorporating a product according to claim 1.

10. A process for the manufacture of a rolled or forged aluminum-based alloy wrought product, according to claim 1, having a volume fraction of recrystallized grains lower than 35% comprising the steps of:

a) casting an ingot comprising

Al
Zn 6.7-7.0
Mg 1.68-1.8
Cu 1.7-1.97
Fe 0-0.13
Si 0-0.10
Ti 0-0.06
Zr 0.08-0.13
Cr 0-0.04
Mn 0-0.04
impurities and other incidental elements ≦0.05 each;

b) homogenizing said ingot at 860-930° F.;

c) hot working with an entry temperature of 640-825° F. said ingot by rolling or forging into a plate with a final thickness from 2 to 10 inches;

d) solution heat treating and quenching said plate;

e) stretching said plate with a permanent set from 1 to 4%;

f) aging said plate by heating at 230-250° F. for 5 to 12 hours and 300-360° F. for 5 to 30 hours, for an equivalent time t(eq) between 31 and 56 hours;

The equivalent time t(eq) being defined by the formula:

$$t(eq) = \frac{\int \exp(-16000/T)dt}{\exp(-16000/T_{ref})}$$

where T is the instantaneous temperature in ° K during annealing and $T_{ref}$ is a reference temperature selected at 302° F. (423° K), and t(eq) is expressed in hours.

11. A process according to claim 10 wherein the equivalent time t(eq) is from 33 to 44 hours.

12. A process according to claim 10 wherein time between quenching and stretching is not more than 2 hours.

13. An aircraft or aerospace product comprising a product of claim 1.

14. A product of claim 1 that is substantially unrecrystallized.

15. A product of claim 1 wherein the alloy consists of

Al
Zn 6.7-7.0
Mg 1.68-1.8
Cu 1.7-1.97
Fe 0-0.13
Si 0-0.10
Ti 0-0.06
Zr 0.08-0.13
Cr 0-0.04
Mn 0-0.04 impurities and other incidental elements ≦0.05 each, wherein said product comprises the following properties:

a) a minimum life without failure after stress corrosion cracking (SCC) of at least 50 days at a short transverse (ST) stress level of 40 ksi, b) a conventional tensile yield strength measured in the L direction at quarter thickness of at least 70-0.32t ksi (t being the thickness of the product in inch), and c) toughness in the L-T direction measured at quarter thickness of at least 42-1.7t ksi √in (t being the thickness of the product in inch).

* * * * *